US006829453B2

(12) United States Patent
Kouzu

(10) Patent No.: US 6,829,453 B2
(45) Date of Patent: Dec. 7, 2004

(54) CARRYING APPARATUS AND IMAGE FORMING APPARATUS INCLUDING SAME IN WHICH THE RELATIVE POSITIONING OF CARRYING ROLLERS IS AUTOMATICALLY ADJUSTED

(75) Inventor: Norio Kouzu, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/377,778

(22) Filed: Mar. 4, 2003

(65) Prior Publication Data

US 2004/0175204 A1 Sep. 9, 2004

(51) Int. Cl.[7] ..... G03G 21/00
(52) U.S. Cl. ..... 399/124
(58) Field of Search ..... 399/21, 107, 124, 399/125

(56) References Cited

U.S. PATENT DOCUMENTS 5,200,781 A * 4/1993 Hata ..... 399/125
5,300,998 A * 4/1994 Ogisawa et al. ..... 399/124
5,802,426 A * 9/1998 Miyazaki et al. ..... 399/124 X
5,839,032 A * 11/1998 Yasui et al. ..... 399/124
5,897,244 A * 4/1999 Miyazaki et al. ..... 399/124 X
5,974,290 A 10/1999 Inoue
6,621,997 B2 * 9/2003 Chung ..... 399/124 X
6,678,490 B2 * 1/2004 Tanaka ..... 399/124

FOREIGN PATENT DOCUMENTS

JP 6-110278 A 4/1994
JP 7-157132 A 6/1995
JP 11-310356 A 11/1999

* cited by examiner

*Primary Examiner*—Sandra L. Brase
(74) *Attorney, Agent, or Firm*—Foley & Lardner LLP

(57) ABSTRACT

A carrying apparatus comprises a carrying device which has a first roller supported by a main unit through a first support shaft, and a second roller supported by the open/close cover through a second support shaft, and which holds and carries a material to be carried by the first and second rollers, and a lock device which is fixed to the second support shaft and is removably engaged with the first support shaft, for locking the open/close cover to the main unit and determining the relative position of the first and second rollers.

12 Claims, 5 Drawing Sheets

CARRYING APPARATUS AND IMAGE FORMING APPARATUS INCLUDING SAME IN WHICH THE RELATIVE POSITIONING OF CARRYING ROLLERS IS AUTOMATICALLY ADJUSTED

BACKGROUND OF THE INVENTION

The present invention relates to a carrying apparatus provided in an electrophotographic copier, for example, for holding and carrying paper, and an image forming apparatus for forming an image on the paper carried by the carrying apparatus.

An apparatus shown in FIG. 8, for example, is well known as an image forming apparatus of this type.

In FIG. 8, reference numeral 101 denotes the main unit of the apparatus. The main unit 101 contains an image forming unit 102 for forming an image on the paper as a carried medium and a paper feed unit 103 for feeding paper to the image forming unit 102.

The image forming unit 102 is provided with a photoconductive rotary drum 106 as an image holding member. On the circumference of the photoconductive drum 106, an electrifier 107, scanning optics to take in an image light 108 (not shown), a developing unit 109, a transfer charger 110, a separation charger 111, a cleaning unit 112, and a de-electrifier 113 are arranged along the drum rotating direction.

The paper feed unit 103 has a paper feed cassette 115 set at the inner bottom of the main unit 101, and a paper carrying path 116 which carries upward the paper fed from the paper feed cassette 115. Paper P is loaded in the paper feed cassette 115, and fed by rotation of a paper feed roller 114. In the paper feeding direction of the paper feed roller 114, a separation roller 124 and a feed roller 125 are provided to separate and feed sheets of paper one by one.

The paper carrying path 116 is provided along a vertical direction. In the carrying path 116, a pair of carrying rollers 117, a pair of registration rollers 118, an image transfer unit 119, a pair of fixing rollers 120 and a pair of eject rollers 121 are arranged in order from downstream to upstream. The pair of carrying rollers 117 comprises a drive roller 117*a* as a first roller and a follower roller 117*b* as a second roller which rotates contacting with the drive roller 117*a*. An ejected paper tray 122 is provided on the paper ejection side of the pair of eject rollers 121.

When an image is formed, the surface of the photoconductive drum 106 is electrified by the electrifier 107, the image light 108 is radiated to the surface of the electrified photoconductive drum 106, and an electrostatic latent image corresponding to a document image is formed. This electrostatic latent image sent to the developing unit 109 by the rotation of the photoconductive drum 106, and the latent image is developed to a toner image by the developer supplied from the developing unit 109.

On the other hand, in this time, the paper P is supplied by rotation of the paper feed roller 114, and the paper P is held and carried by the pair of carrying rollers 117. The paper P is adjusted in position by the pair of registration rollers 118, sent to the image transfer unit 119 located between the photoconductive drum 106 and transfer charger 110, where the magnetic toner image formed on the photoconductive drum 106 is transferred to the paper P. The paper P having the transferred magnetic toner image is separated from the photoconductive drum 106 by the action of the separation charger 111, and carried. The paper P is sent to the pair of fixing rollers 120, where the transferred toner image is fixed to the paper P, and the paper is ejected to the ejected paper tray 122 by the rotation of the pair of paper eject rollers 121.

The paper supplied from the paper feed cassette 115 and sent to the carrying path 116 may jam in the pair of carrying rollers 117. To enable removal of the jammed paper, an open/close cover 127 which opens and closes the carrying path 116 is provided in the lower part of one side of the main unit 101. The drive roller 117*a* of the pair of carrying rollers 117 is fixed to the main unit 101, and the follower roller 117*b* is fixed to the open/close cover 127. The follower roller 117*b* contacts with and separates from the drive roller 117*a* each time the open/close cover 127 is closed and opened.

The lower side of the open/close cover 127 is rotatably fixed to the main unit 101 through a support shaft 129, and the upper side is provided with a lock device 130 which locks the open/close cover 127 to the main unit 101.

The lock device 130 comprises a lock lever 131 and a stopper pin 132. The lock lever 131 is rotatably fixed to the open/close cover 127 through a support shaft 133. The stopper pin 132 is fixed to the main unit 101. The forward end of the lock lever 131 is formed with a hook 131*a*, and the rear end is connected to an operation lever 134. The lock lever 131 is rotated by the operation of the operation lever 134, so that the open/close cover 127 is locked to the main unit 101 with the hook 131*a* removably engaged with the stopper pin 132.

When removing paper jammed in the pairs of carrying rollers 117, the operation lever 134 is operated and the lock lever 131 is turned in the direction of arrow A centering around the support shaft 133. As a result, the hook 131*a* of the lock lever 131 separates from the stopper pin 132, and the lock is released. After the lock is released, the open/close cover 127 is opened by turning it in the direction of arrow B centering around the support shaft 129. As a result, the follower rollers 117*b* separates from the drive roller 117*a*, the carrying path 116 is opened, and the jammed paper can be removed.

If the drive roller 117*a* and follower roller 117*b* which constitute the pair of carrying rollers 117 are not exactly positioned, the paper carrying accuracy will be lowered.

Thus, in the conventional apparatus, the dimensional accuracy of the open/close cover 127 to which the follower roller 117*b* is fixed is strictly controlled, or a mechanism for positioning the drive roller 117*a* and follower roller 117*b* is required as an optional unit.

However, there is a problem in the former case that the dimensional control of the open/close cover is difficult, and another problem arises in the latter case that the number of parts increases and the cost increases.

BRIEF SUMMARY OF THE INVENTION

The present invention has been made in order to solve the above problems. It is an object of the present invention is to provide a carrying apparatus capable of positioning a first roller and a second roller without requiring an optional positioning mechanism, and an image forming apparatus.

According to an aspect of the present invention, there is provided a carrying apparatus comprising a main unit which is opened and closed by an open/close cover; a carrying device which has a first roller supported by the main unit through a first support shaft, and a second roller supported by the open/close cover through a second support shaft, and which holds and carries a material to be carried by the first and second rollers; and a lock device which is fixed to the second support shaft and is removably engaged with the first support shaft, for locking the open/close cover to the main unit and determining the relative position of the first and second rollers.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Hereinafter, the present invention will be explained by referring to the embodiments shown in the accompanying drawings.

Figure 1:
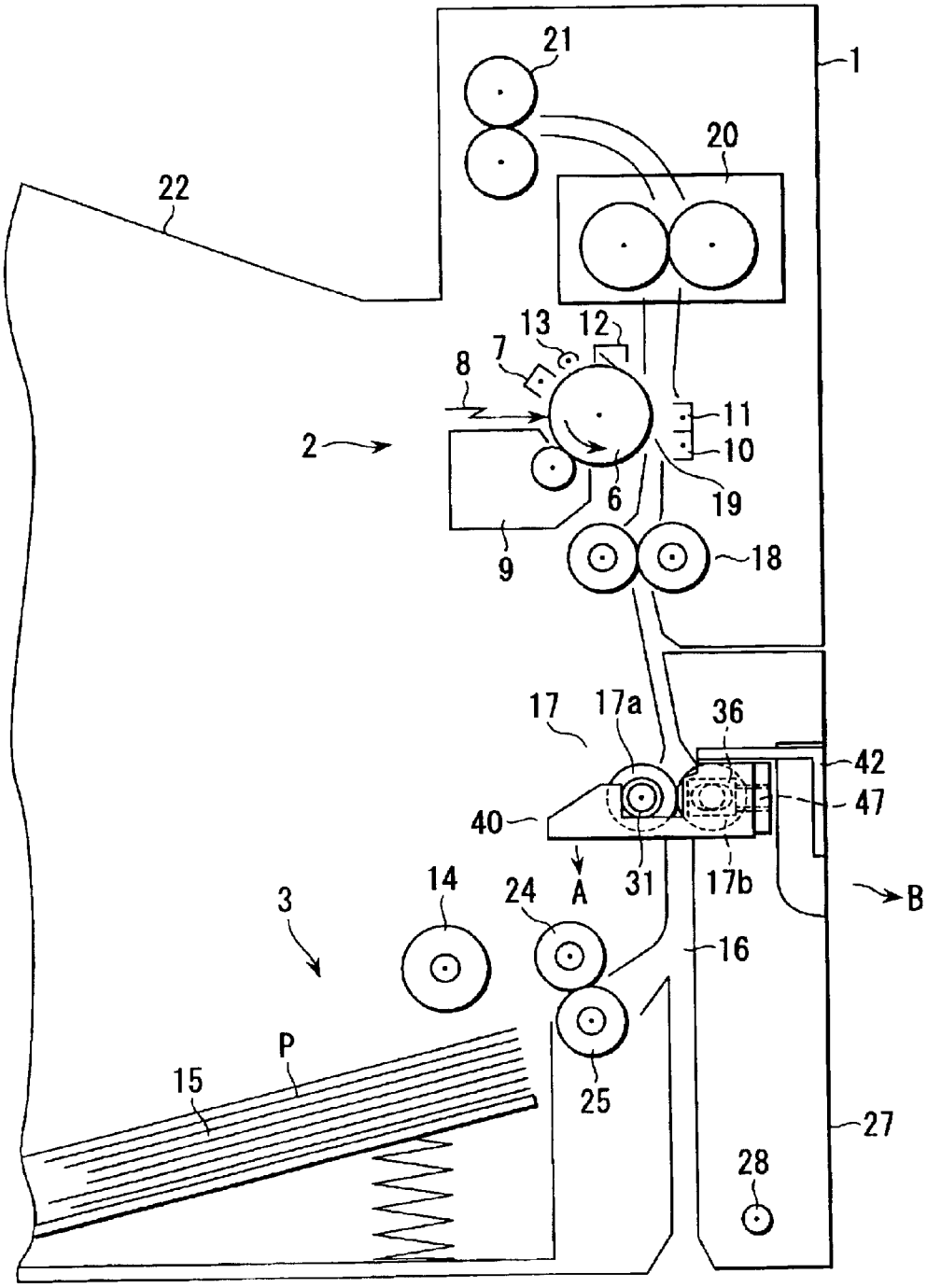
FIG. 1 is a schematic diagram showing an internal mechanism of an electrophotographic copier according to an embodiment of the present invention.

FIG. 1 is a schematic diagram showing an image forming apparatus according to an embodiment of the present invention.

In FIG. 1, a main unit 1 contains an image forming unit 2 for forming an electrostatic image on paper that is used as a material to be carried, and a paper feed unit 3 for feeding paper to the image forming unit 2.

The image forming unit 2 has a rotary photoconductive rotary drum 6 as an image holding member. On the circumference of the photoconductive drum 6, an electrifier 7, scanning optics to take in an image light 8 (not shown), a developing unit (also called a "developer") 9, a transfer charger 10, a separation charger 11, a cleaning unit 12, and a de-electrifier 13 are arranged along the drum rotating direction.

The paper feed unit 3 has a paper feed cassette 15 set at the inner bottom of the main unit 1, and a paper carrying path 16 which carries upward the paper fed from the paper feed cassette 15. Paper P is loaded in the paper feed cassette 15, and fed by the rotation of a paper feed roller 14. In the paper feeding direction of the paper feed roller 14, a separation roller 24 and a feed roller 25 are provided to separate and feed sheets of paper one by one.

The paper carrying path 16 is provided along a vertical direction. In the carrying path 16, a pair of carrying rollers 17, a pair of registration rollers 18, an image transfer unit 19, a pair of fixing rollers 20 and a pair of eject rollers 21 are arranged in order from downstream to upstream. The pair of carrying rollers 17 comprises a drive roller 17*a* as a first roller and a follower roller 17*b* as a second roller which rotates contacting with the drive roller 17*a*. An ejected paper tray 22 is provided in the paper ejection side of the pair of eject rollers 21.

When an image is formed, the surface of the photoconductive drum 6 is electrified by the electrifier 7, the image light 8 is radiated to the surface of the electrified photoconductive drum 6, and an electrostatic latent image corresponding to a document image is formed. This electrostatic latent image is sent to the developing unit 9 by the rotation of the photoconductive drum 6, and the latent image is developed to a toner image by the developer supplied from the developing unit 9.

When an image is formed, the surface of the photoconductive drum 6 is electrified by the electrifier 7, the image light 8 is radiated to the surface of the electrified photoconductive drum 6, and an electrostatic latent image corresponding to a document image is formed. This electrostatic latent image is sent to a developing unit 9 by the rotation of the photoconductive drum 6, and the latent image is developed to a toner image by the developer supplied from the developing unit 9.

On the other hand, in this time, the paper P is supplied by rotation of the paper feed roller 14, and the paper P is held and carried by the pair of carrying rollers 17. The paper P is adjusted in position by the pair of registration rollers 18, sent to the image transfer unit 19 located between the photoconductive drum 6 and transfer charger 10, where the magnetic toner image formed on the photoconductive drum 6 is transferred onto the paper P. The paper P having the transferred magnetic toner image is separated from the photoconductive drum 6 by the separation charger 11, and carried. The paper P is sent to the pair of fixing rollers 20, where the transferred toner image is fixed to the paper P, and the paper is ejected to the ejected paper tray 22 by the rotation of the pair of paper eject rollers 21.

Figure 2:
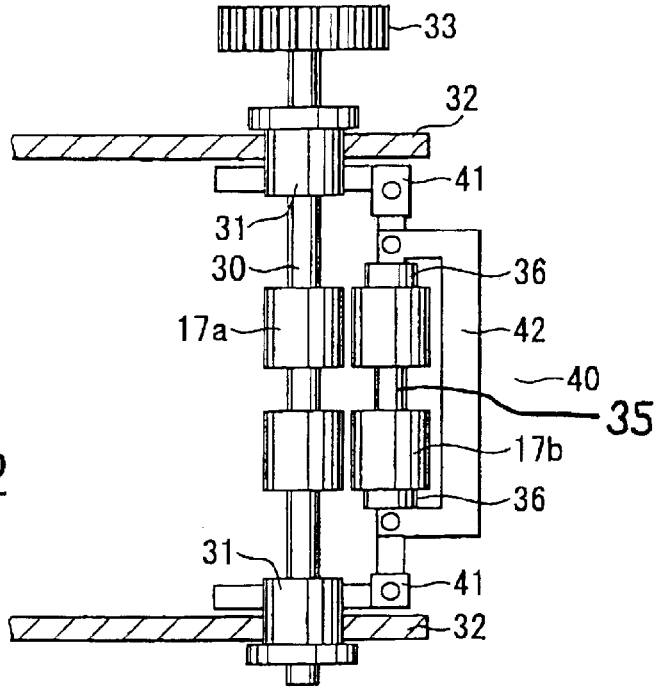
FIG. 2 is a cross-sectional view showing the mounting structure of a pair of carrying rollers of the same embodiment.

FIG. 2 is a cross-sectional view showing the mounting structure of a pair of carrying rollers 17 comprising a drive roller 17*a* and a follower roller 17*b* which rotates contacting with the drive roller 17*a*.

The drive roller 17*a* is supported by a first support shaft 30, and both ends of the first support shaft 30 are held by a main unit frame 32 through bearings 31 and 31. A power transmission gear 33 is fixed to the rear side of the first support shaft 30, and when the power transmission gear 33 rotates, the drive roller 17*a* is rotated and driven.

The follower roller 17*b* is supported by a second support shaft 35 through holding members 36 and 36. Both ends of the second support shaft 35 are held by an open/close cover explained later through holding brackets 37, 37 (shown in FIG. 5).

Figure 3:
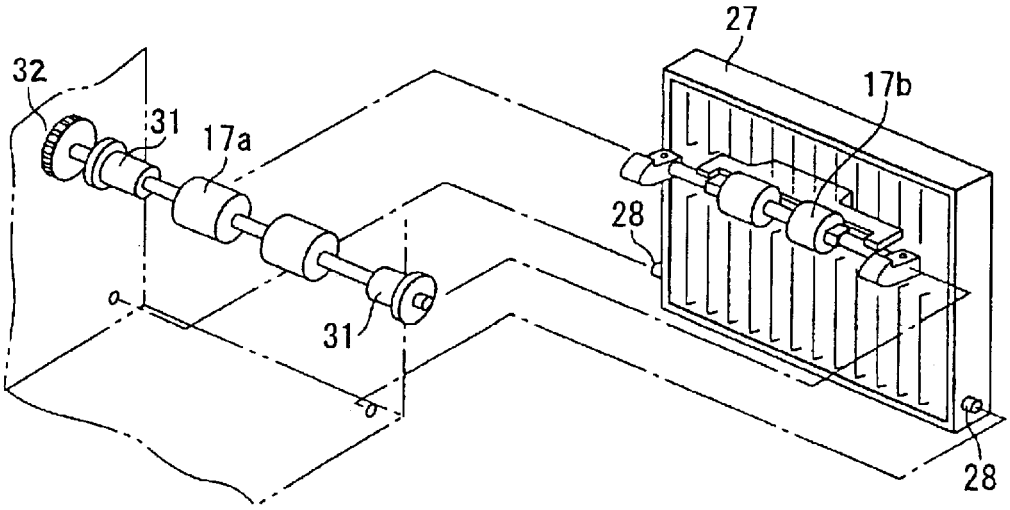
FIG. 3 is a perspective view of the pair of carrying rollers of the same embodiment separated into two sections.

FIG. 3 is a perspective view showing the drive roller 17*a* fixed to the main unit frame 32 and the follower roller 17*b* fixed to an open/close cover 27.

The open/close cover 27 is used to remove the paper fed from the paper feed cassette 15 and jammed in the pair of carrying rollers 17. The open/close cover 27 is rotatably fixed to the main unit frames 32, 32 through support shafts 28, 28 projecting in the lower part of both sides of the cover 27. The follower roller 17*b* fixed to the open/close cover 27 contacts with and separates from the drive roller 17*a* each time the open/close cover 27 is closed and opened.

In the upper part of the open/close cover 27, a lock device 40 is provided, which locks the open/close cover 27 to the main unit frame 32, and determines the relative position of the drive roller 17*a* and follower roller 17*b* of the pair of carrying rollers 17.

Figure 4:
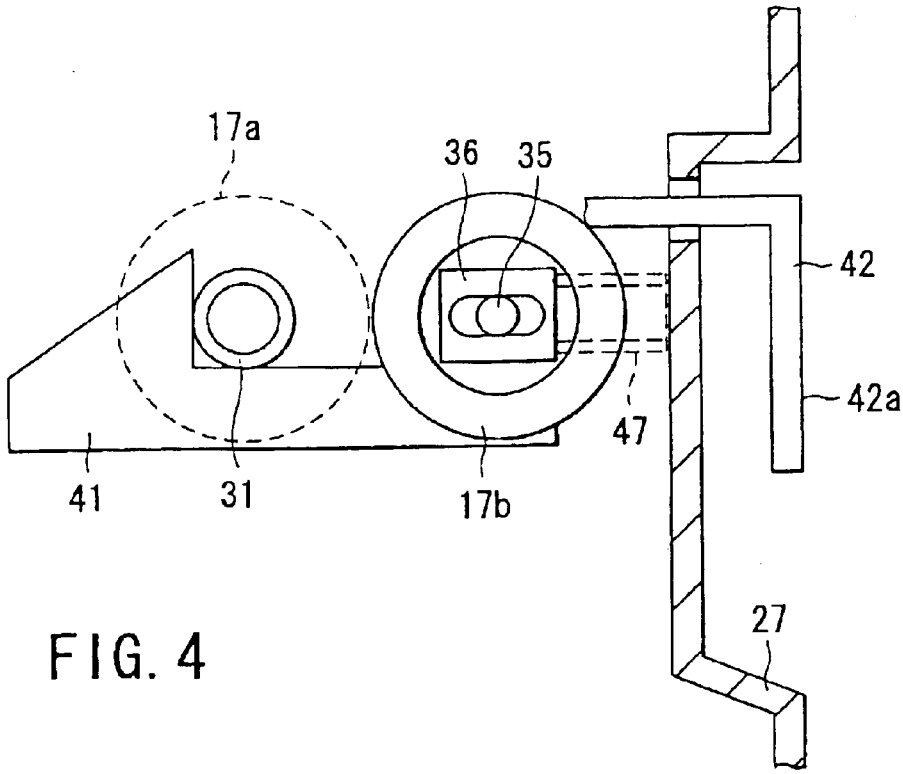
FIG. 4 is a side view of a lock device of the same embodiment.
Figure 5:
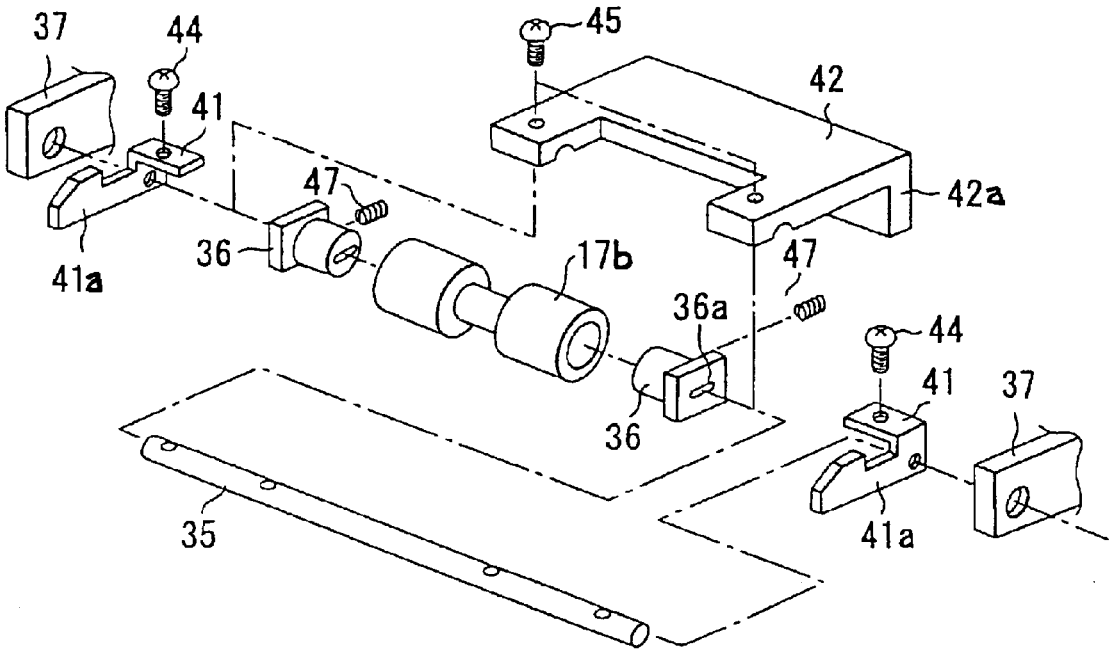
FIG. 5 is an exploded perspective view of the lock device of the same embodiment.

The lock device 40 comprises a pair of lock levers 41, 41 and an operation lever 42, as shown in FIG. 4 and FIG. 5. The pair of lock levers 41, 41 is fixed by a fixing screw 44 to both ends of the second support shaft 35 of the follower roller 17*b*.

The operation lever 42 is fixed by a fixing screw 45 to the second support shaft 35 of the follower roller 17*b*. The operation lever 42 is provided with a knob 42*a*, and this knob 42*a* projects to the outside of the open/close cover 27. The forward end of the lock lever 41 is formed as a hook 41*a* which removably engages with a bearing 31 of the first support shaft 30 of the drive roller 17*a*.

The holding member 36 of the follower roller 17*b* is elastically energized by a spring material 47. The second support shaft 35 is inserted into a through hole 36*a* of the holding member 36, and the through hole 36*a* is made elliptical along the radial direction of the follower roller 17*b*. Therefore, the follower 17*b* is movable in the radial direction.

The open/close cover 27 is locked to the main unit frame 32, when the hooks 41*a*, 41*a* of the lock levers 41, 41 of the lock device 40 are engaged with the bearings 31, 31 of the first support shaft 30.

During the above-mentioned image forming process, the paper P fed from the paper feed cassette 15 may jam between the drive roller 17*a* and follower roller 17*b* of the pair of carrying rollers 17.

In this case, the lock levers 41, 41 are turned in the direction of arrow A shown in FIG. 1 by operating the operation lever 42. As a result, the hooks 41*a*, 41*a* separate from the bearings 31, 31 of the first support shaft 30, and release the lock. Thereafter, the open/close cover 27 is opened in the direction of arrow B shown in FIG. 1, thereby causing the follower roller 17*b* to separate from the drive roller 17*a*, so that the jammed paper P can be removed.

After removing the paper P, the open/close cover 27 is closed. As a result, the hooks 41*a*, 41*a* of the lock levers 41, 41 engage with the bearings 31, 31 of the first support shaft 30 of the drive roller 17*a*, to lock the open/close cover 27.

When the open/close cover 27, is locked: (a) the hooks 41*a*, 41*a* of the lock levers 41, 41 engage the bearings 31, 31 of the first support shaft 30 of the drive roller 17*a*; (b) the distance between the shafts 30, 35 of the drive roller 17*a* and the follower roller 17*b* is regulated over the shaft direction; (c) the rollers 17*a*, 17*b* are pressed contacting each other and kept parallel; and (d) the drive roller 17*a* and the follower roller 17*b* are exactly and relatively positioned.

Therefore, the positioning of the drive roller 17*a* and follower roller 17*b* becomes possible without increasing the accuracy of the open/close cover 27, as in the conventional apparatus.

Further, since the drive roller 17*a* and the follower roller 17*b* are positioned by using the lock levers 41, 41 constituting the lock device 40, the lock member can be used compatibly with a positioning member and the cost can be reduced.

Figure 6:
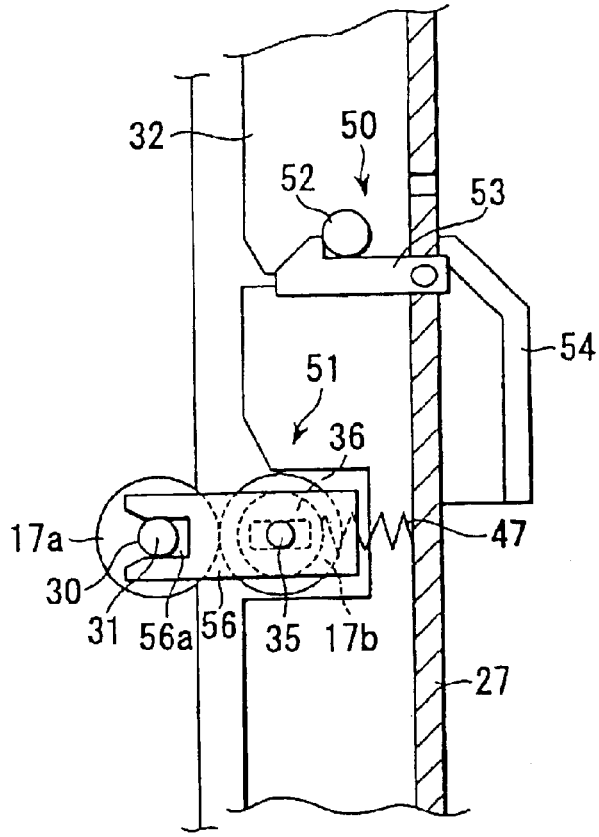
FIG. 6 is a view showing a positioning device according to another embodiment of the present invention.

FIG. 6 shows a second embodiment of the present invention.

In this embodiment, a lock device 50 for locking the open/close cover 27 and a positioning device 51 for positioning the pair of carrying rollers 17 are separately provided.

The lock device 50 comprises a pin 52 provided in the main unit frame 32, a lock lever 53 provided in the open/close cover 27, and an operation lever 54 for operating the lock lever 53.

When the open/close cover 27 is closed, the lock lever 53 engages with the pin 52, and the open/close cover 27 is locked.

The positioning device 51 has a positioning member 56 fixed to both ends of the second support shaft 35 of the follower roller 17*b*. A concave 56*a* is formed at the forward end of the positioning member 56.

When the open/close cover 27 is closed, the concave 56*a* of the positioning member 56 catches the bearing 31 of the first support shaft 30 of the drive roller 17*a*. The distance between the shafts 30, 35 of the drive roller 17*a* and the follower roller 17*b* is regulated over the shaft direction, and the rollers 17*a*, 17*b* are pressed contacting each other and kept in parallel. By this contacting press, the drive roller 17*a* and the follower roller 17*b* are relatively positioned.

In this embodiment, also, the positioning of the drive roller 17*a* and the follower roller 17*b* becomes possible without strictly controlling the dimensional accuracy of the open/close cover 27.

Figure 7:
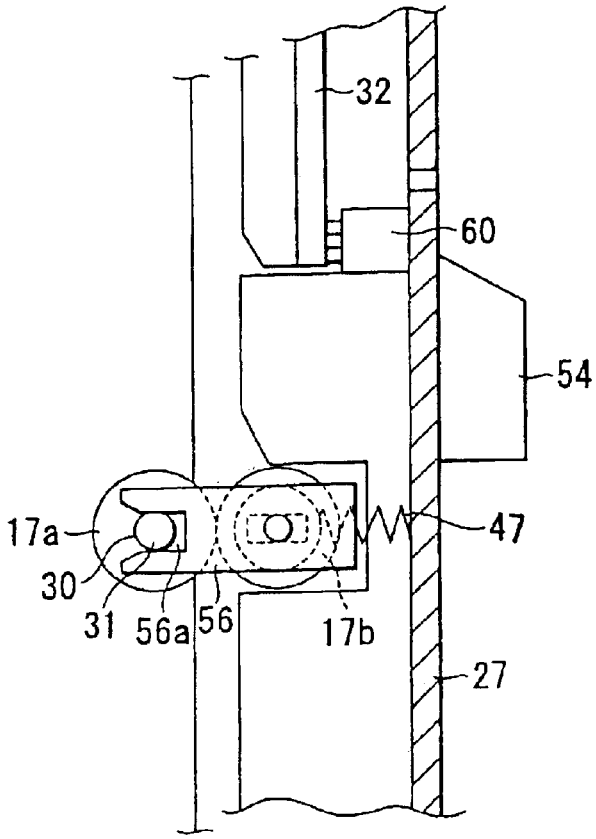
FIG. 7 is a view showing a lock device according to another embodiment of the present invention.
Figure 8:
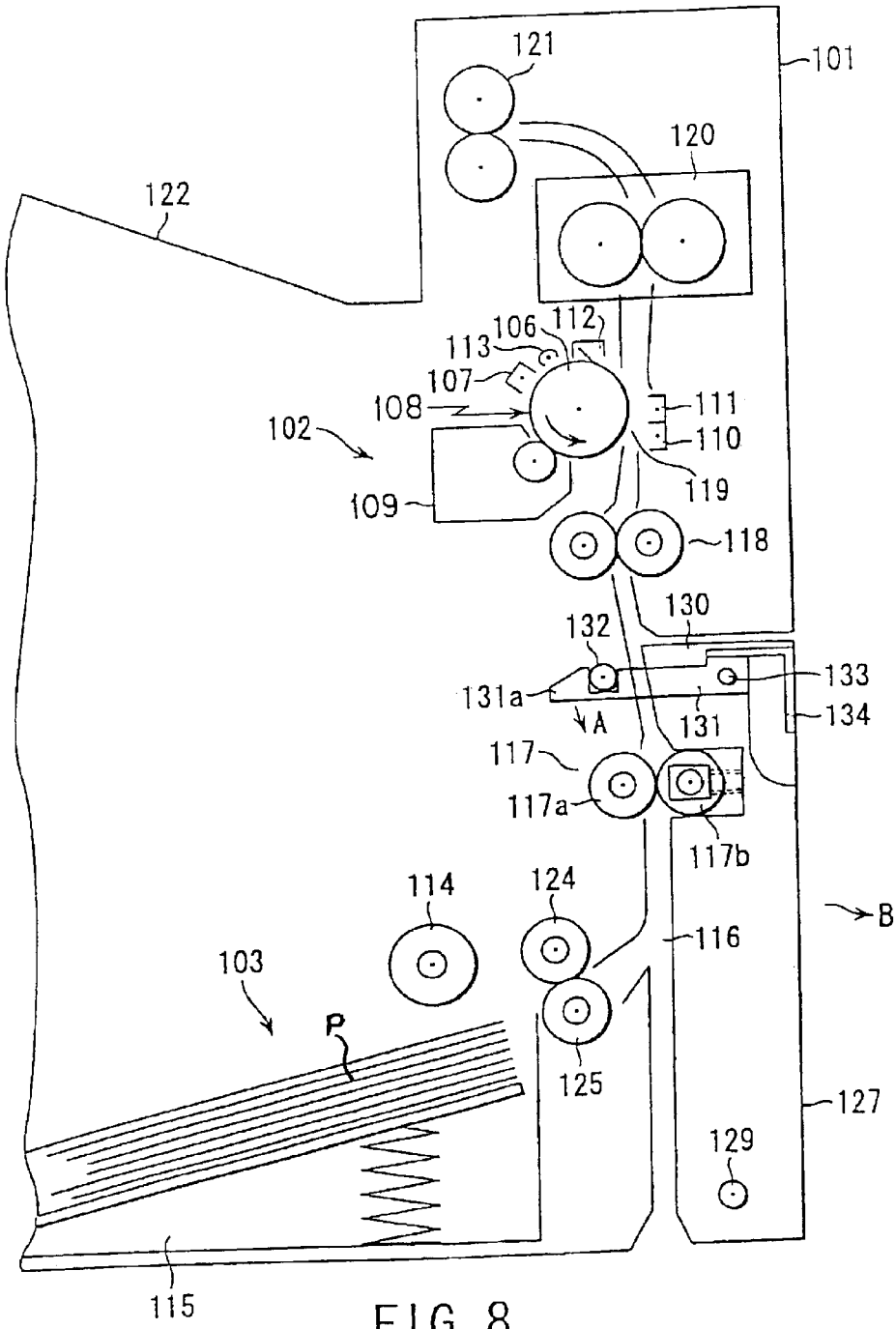
FIG. 8 PRIOR ART
FIG. 8 is a schematic diagram showing an internal mechanism of a prior art electrophotographic copier.

FIG. 7 shows a third embodiment of the present invention.

In FIG. 7, the same reference numerals are given to the same components as those in FIG. 6, and the description will be omitted.

In this embodiment, a magnet 60 is used as a lock device, and the open/close cover 27 is locked to the main unit frame 32 by the magnetic force of the magnet 60.

It is a matter of course that the present invention is not limited to the above mentioned embodiments, and may be modified without departing from its essential characteristics.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A carrying apparatus comprising:

a main unit which is opened and closed by an open/close cover;

a carrying device which has a first roller supported by the main unit through a first support shaft, and a second roller supported by the open/close cover through a second support shaft, and which holds and carries a material to be carried by the first and second rollers; and a lock device which is fixed to the second support shaft and is removably engaged with the first support shaft, for locking the open/close cover to the main unit and determining the relative position of the first and second rollers.

2. A carrying apparatus according to claim 1, wherein the lock device has a lock lever which has a hook to engage removably with the first support shaft, and an operation lever which rotates the lock lever and engages the hook with the first support shaft.

3. A carrying apparatus comprising:

a main unit which is opened and closed by an open/close cover;

a carrying device which has a first roller supported by the main unit through a first support shaft, and a second roller supported by the open/close cover through a second support shaft, and which holds and carries a material to be carried by the first and second rollers;

a lock device which locks the open/close cover to the main unit; and a positioning device which is fixed to the second support shaft and is removably engaged with the first support shaft, for determining the relative position of the first and second rollers.

4. A carrying apparatus according to claim 3, wherein the positioning device has a recess to engage removably with the first support shaft.

5. A carrying apparatus according to claim 3, wherein the lock device has a stopper pin provided in the main unit, a lock lever provided in the open/close cover and stopped by the stopper pin, and an operation lever which rotates the lock lever and engages with the stopper pin.

6. A carrying apparatus according to claim 3, wherein the lock device has a magnet which locks the open/close cover to the main unit by magnetic attraction.

7. An image forming apparatus comprising:

an image forming device which forms a developer image on an image holding member;

a supply device which supplies a member to be transferred;

a transfer device which transfers the developer image formed by the image forming device onto the member to be transferred supplied from the supply device;

a main unit which contains the image forming device and the transfer device, and which is opened and closed by an open/close cover;

a carrying device which has a first roller supported by the main unit through a first support shaft, and a second roller supported by the open/close cover through a second support shaft, and which holds and carries a material to be carried by the first and second rollers; and a lock device which is fixed to the second support shaft and is removably engaged with the first support shaft, for locking the open/close cover to the main unit and determining the relative position of the first and second rollers.

8. An image forming apparatus according to claim 7, wherein the lock device has a lock lever which has a hook to engage removably with the first support shaft, and an operation lever which rotates the lock lever and engages the hook with the first support shaft.

9. An image forming apparatus comprising:

an image forming device which forms a developer image on an image holding member;

a supply device which supplies a member to be transferred;

a transfer device which transfers the developer image formed by the image forming device onto the member to be transferred supplied from the supply device;

a main unit which contains the image forming device and the transfer device, and which is opened and closed by an open/close cover;

a carrying device which has a first roller supported by the main unit through a first support shaft, and a second roller supported by the open/close cover through a second support shaft, and which holds and carries a material to be carried by the first and second rollers;

a lock device which locks the open/close cover to the main unit; and a positioning device which is fixed to the second support shaft and is removably engaged with the first support shaft, for determining the relative position of the first and second rollers.

10. An image forming apparatus according to claim 9, wherein the positioning device has a recess to engage removably with the first support shaft.

11. An image forming apparatus according to claim 9, wherein the lock device has a stopper pin provided in the main unit, a lock lever provided in the open/close cover and stopped by the stopper pin, and an operation lever which rotates the lock lever and engages with the stopper pin.

12. An image forming apparatus according to claim 9, wherein the lock device has a magnet to lock the open/close cover to the main unit by magnetic attraction.

* * * * *